United States Patent [19]

Magnuson

[11] 4,019,422

[45] Apr. 26, 1977

[54] VEHICULAR MOUNTED TOW MISSILE SYSTEM

[75] Inventor: Roland A. Magnuson, Renton, Wash.

[73] Assignee: Paccar Inc., Bellevue, Wash.

[22] Filed: July 19, 1976

[21] Appl. No.: 706,806

[52] U.S. Cl. ..... 89/1.815; 89/41 E; 89/41 H; 244/3.12

[51] Int. Cl.[2] ..... F41F 3/04; F41G 1/38

[58] Field of Search ..... 89/1.8, 1.815, 41 R, 89/41 E, 41 M, 41 H; 244/3.12, 3.13

[56] References Cited

UNITED STATES PATENTS 3,466,968 9/1969 Stangl et al. ..... 89/1.815

*Primary Examiner*—Stephen C. Bentley

*Attorney, Agent, or Firm*—Seed, Berry, Vernon & Baynahm

[57] ABSTRACT

A base of a TOW missile system is mounted on a rotatable turret of a vehicle and is also rotatably mounted relative to the rotation of the turret so that the orientation of the base about its own rotational axis remains stationary. The positioning of the TOW base on the turret allows the turret to rotate generally about an axis which can be aligned with the person operating the sight. Thus the diameter of the opening in the vehicle is reduced. One embodiment uses a planetary gear system for holding the orientation of the base. A second embodiment uses a flexible link.

11 Claims, 12 Drawing Figures

FIG. 1
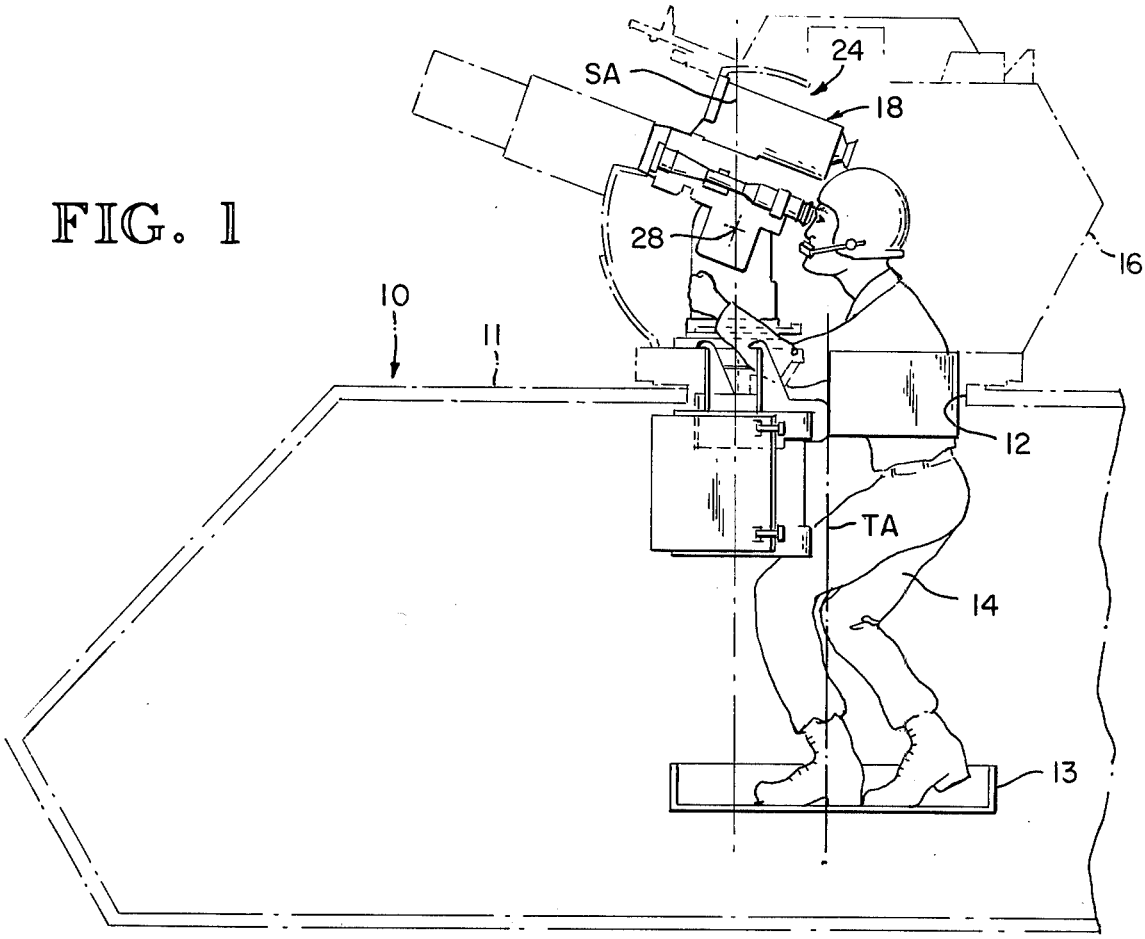
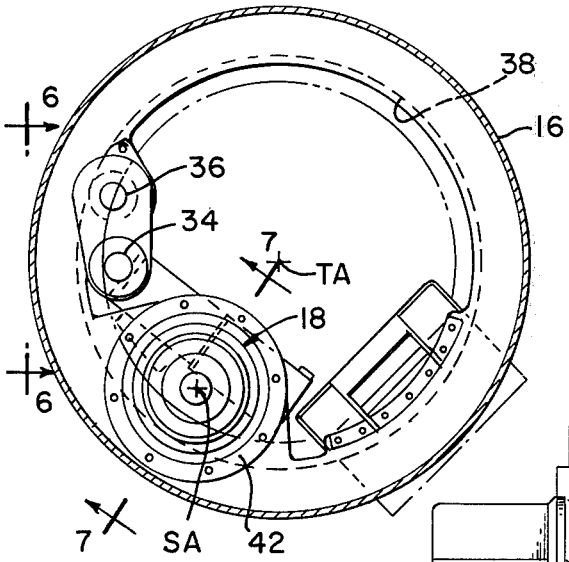
FIG. 2
FIG. 3
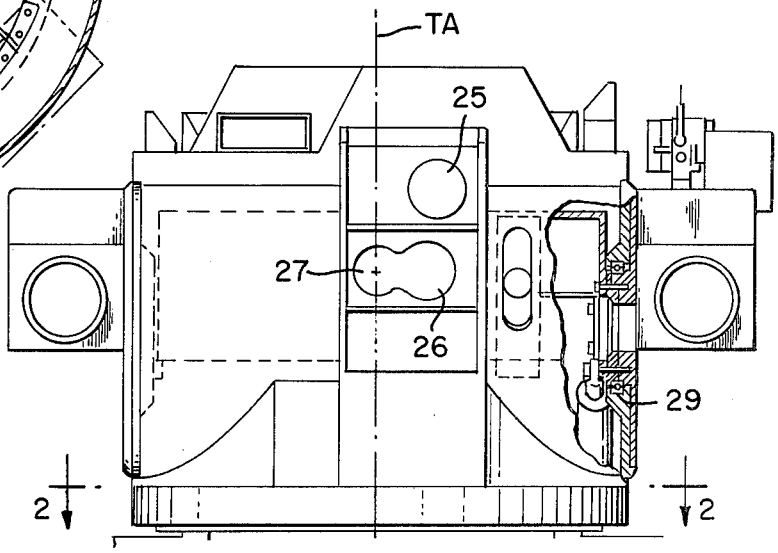

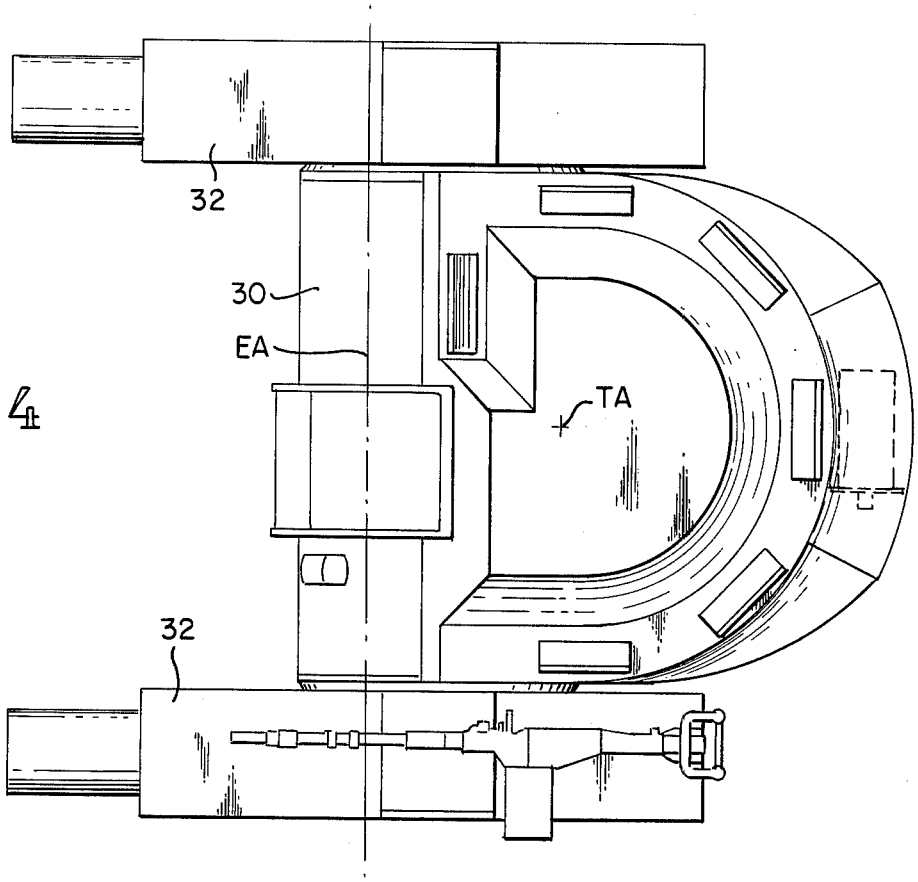
FIG. 4
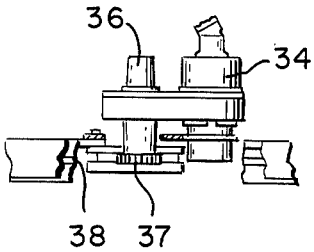
FIG. 6
FIG. 5
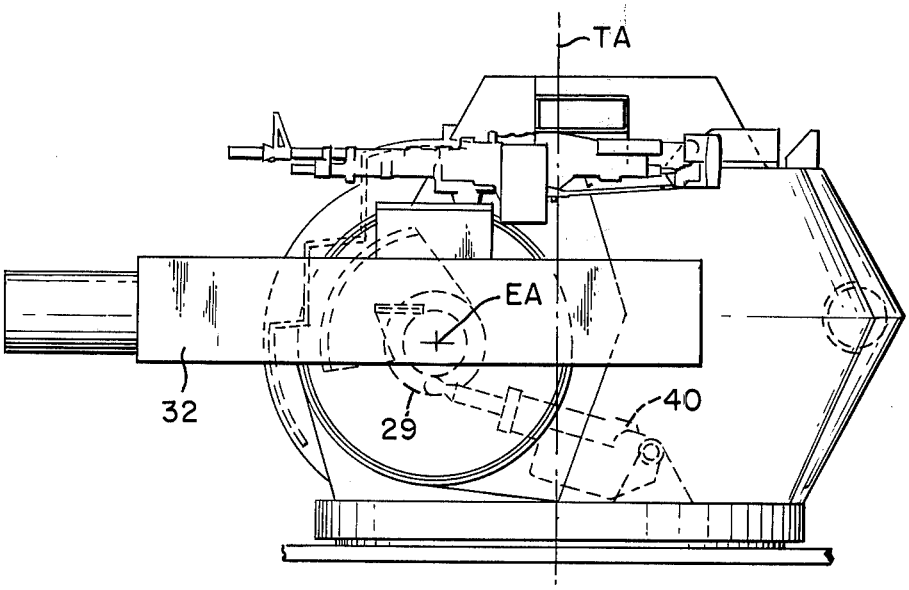

FIG. 7
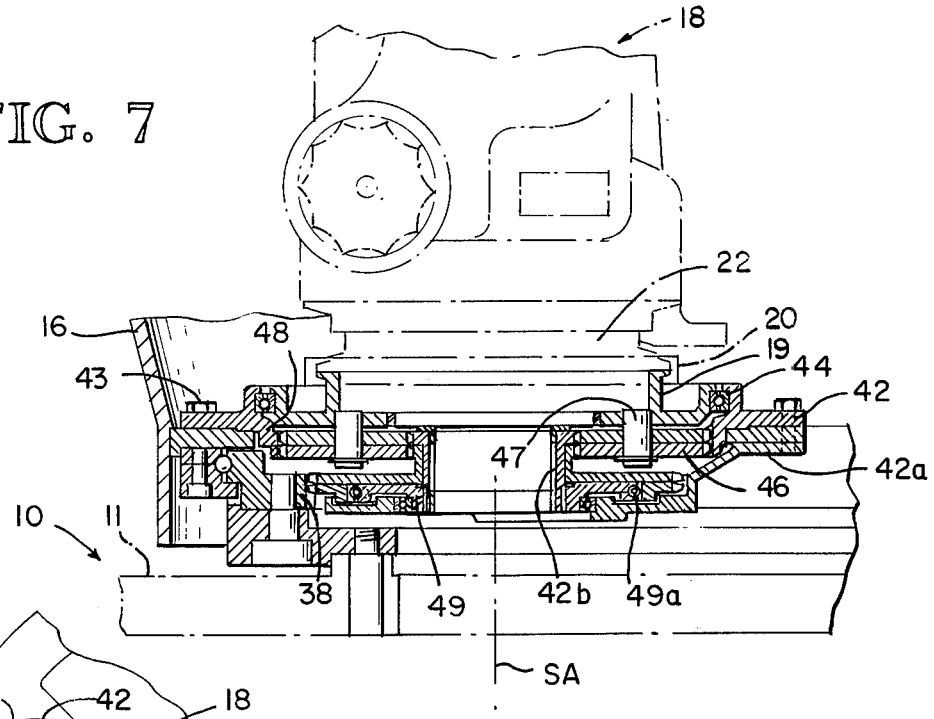
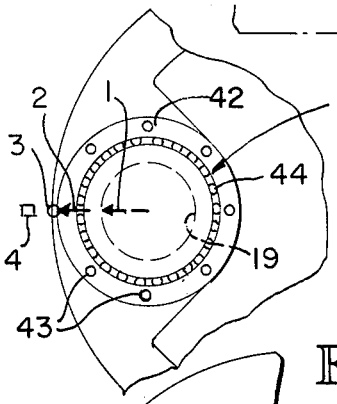
FIG. 8A
FIG. 8B
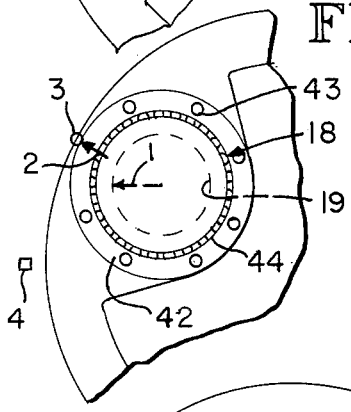
FIG. 9
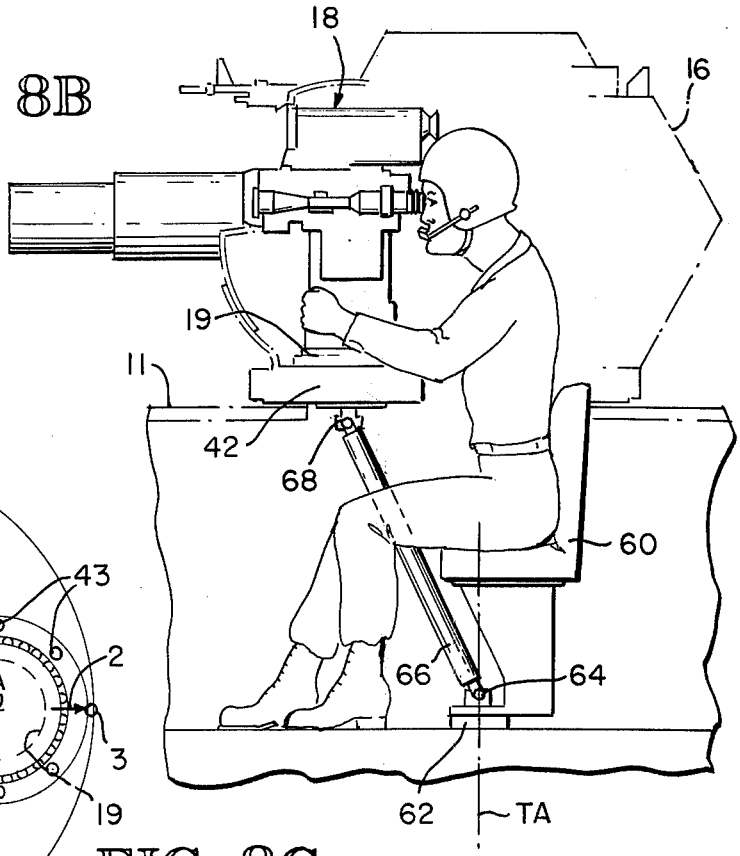
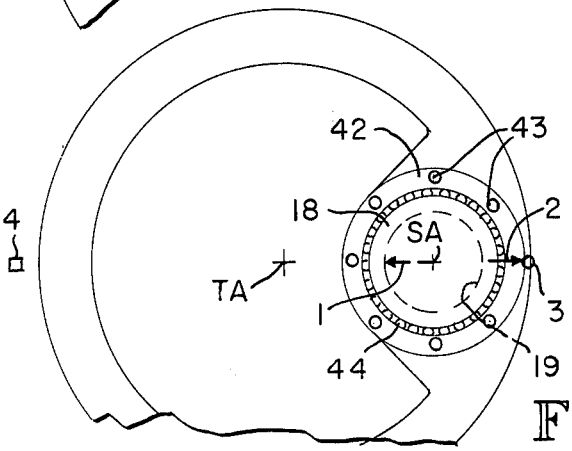
FIG. 8C

VEHICULAR MOUNTED TOW MISSILE SYSTEM

BACKGROUND OF THE INVENTION

1. Field of the Invention

This invention pertains to sighting devices which are secured to a turret or other heavy piece of equipment which rotates in response to changes in direction of the sight. More particularly, the invention pertains to a vehicular mounted TOW missile system which holds the base of the sighting unit relatively stationary about its axis of rotation to simulate the operation of a ground-mounted TOW missile system.

2. Description of the Prior Art

It is well established that the TOW (tube launched optically tracked, wire command, link guided) missile system of the type described in United States Army Technical Manual TM 9-1425-470-12, January, 1974, is a proven and perhaps unequalled system for tracking accuracy. The system uses a manually operated, viscous damped, position control, weapon pointing system. The system is generally mounted on a tripod which is stationary on the ground or on a vehicle with a post that is fixed to the vehicle and with the vehicle stationary on the ground. The operator then in sighting walks around the tripod or post with the missile launch tube being connected to the sight and thus movable directly therewith. The sighting mechanism has a day sight which is spaced vertically from a night sight and is also provided with an infrared sensing sight aligned with the day sight. Basically the operation of the missile system requires that the operator locate the cross hairs of one of the optical sights on the moving target and fires the missile. The operator then maintains the cross hairs on the target by moving the sight either elevationally or rotationally in traverse with the infrared sensing sight locating the missile and sending control signals to the missile to direct the missile from its initially fired direction to a corrected direction corresponding to the direction indicated by the cross hairs of the optical sight.

It is desirable to mount a missile weapon system on a vehicle in a manner in which the operator is completely protected by heavy armor plate. That is, it is desirable to mount such a TOW missile system in a personnel carrier or a tank and preferably to mount it within the conventional rotatable turret in the vehicle. Most modern vehicular-mounted gun controls, such as presently in tanks, however are "rate" control systems as compared to the TOW weapon "position" control system. In a rate system the operator displaces his controls by an amount required to generate a turret turning velocity equivalent to the apparent velocity of the target. Thus, when tracking a constant speed target, the controls would be held displaced but stationary. As the target accelerated the control would also be moved to achieve a more rapid turning rate of the turret and if the target decelerated while traveling still in the same direction, the control would have to be retracted back by movement in a direction opposite to the direction of movement of the target. Unfortunately, rate control systems have been shown to be less accurate for the TOW type missile launcher then position control systems for the TOW type; missile launcher. Additionally, it requires extensive training to convert an experienced TOW operator from a position control operator to a rate control operator.

SUMMARY OF THE INVENTION

It is an object of the invention to provide a position control system for a vehicle turret mounted TOW type missile system in which the control closely simulates the position control of a ground-mounted TOW system.

It is another object of this invention to provide a vehicular-mounted position control system whose orientation remains generally stationary with respect to the ground.

It is still another object of this invention to provide a vehicular-mounted TOW missile system in which the hull opening is of a minimum size.

Basically, these objects are obtained by modifying the standard TOW missile system components and securing them to the turret in a vehicle but providing a counter rotation to parts of the components so that with rotational movement of the turret, the base component of the control will remain generally stationary about its own rotational axis relative to a point on the hull of the vehicle. In the preferred embodiment of the invention, the axis of rotation of the base component of the control is also offset laterally from the rotational axis of the turret so that the operator can be located generally along the axis of rotation of the turret thus reducing the diameter of the hull opening and thus the size of the turret to a minimum diameter necessary only to allow for the rotational movement of the sighting system about the rotational axis of the turret. One embodiment for providing this simulated ground-mounted position control with an offset sighting axis is provided with a planetary drive transmission which provides a counter rotation to the base of the control component as the turret upon which the base is mounted rotates in the other direction. Various other types of spur gear drive transmissions to achieve this function are also possible. Still another embodiment is to use a flexible, universal type linkage which prevents rotation of the base about its own axis while the base is being moved about the rotational axis of the turret during movement of the turret.

As is readily apparent, the advantages of these systems are that the accuracy obtained is essentially identical to that of the ground-mounted TOW missile system. Secondly, the operation is identical to the ground-mounted TOW missile system so that training requirements are minimized. Still further, the operator can be positioned centrally in the turret with the diameter of the turret being small enough to merely allow rotation of the sight around the operator rather than rotation of the operator around the sight.

BRIEF DESCRIPTION OF THE FIGURES OF THE DRAWING

FIG. 1 is a schematic side elevation of a portion of the vehicle embodying the unique TOW missile mounting system.

FIG. 2 is a fragmentary horizontal section taken along the line 2—2 of FIG. 3.

FIG. 3 is a fragmentary front elevation of a turret mounting the unique missile control system shown in FIG. 1.

FIG. 4 is a plan view of the vehicle shown in FIG. 1.

FIG. 5 is a side elevation of the system shown in FIG. 1.

FIG. 6 is a fragmentary vertical section showing the drive for the turret of the vehicle shown in FIG. 1.

FIG. 7 is a fragmentary vertical section taken through the TOW missile control system embodying the principles of the invention.

FIGS. 8A–8C are operational schematics illustrating the principles of the control of this application.

FIG. 9 is a schematic illustration of a second embodiment of the missile control mounting system.

DESCRIPTION OF THE PREFERRED EMBODIMENTS

Figure 10:
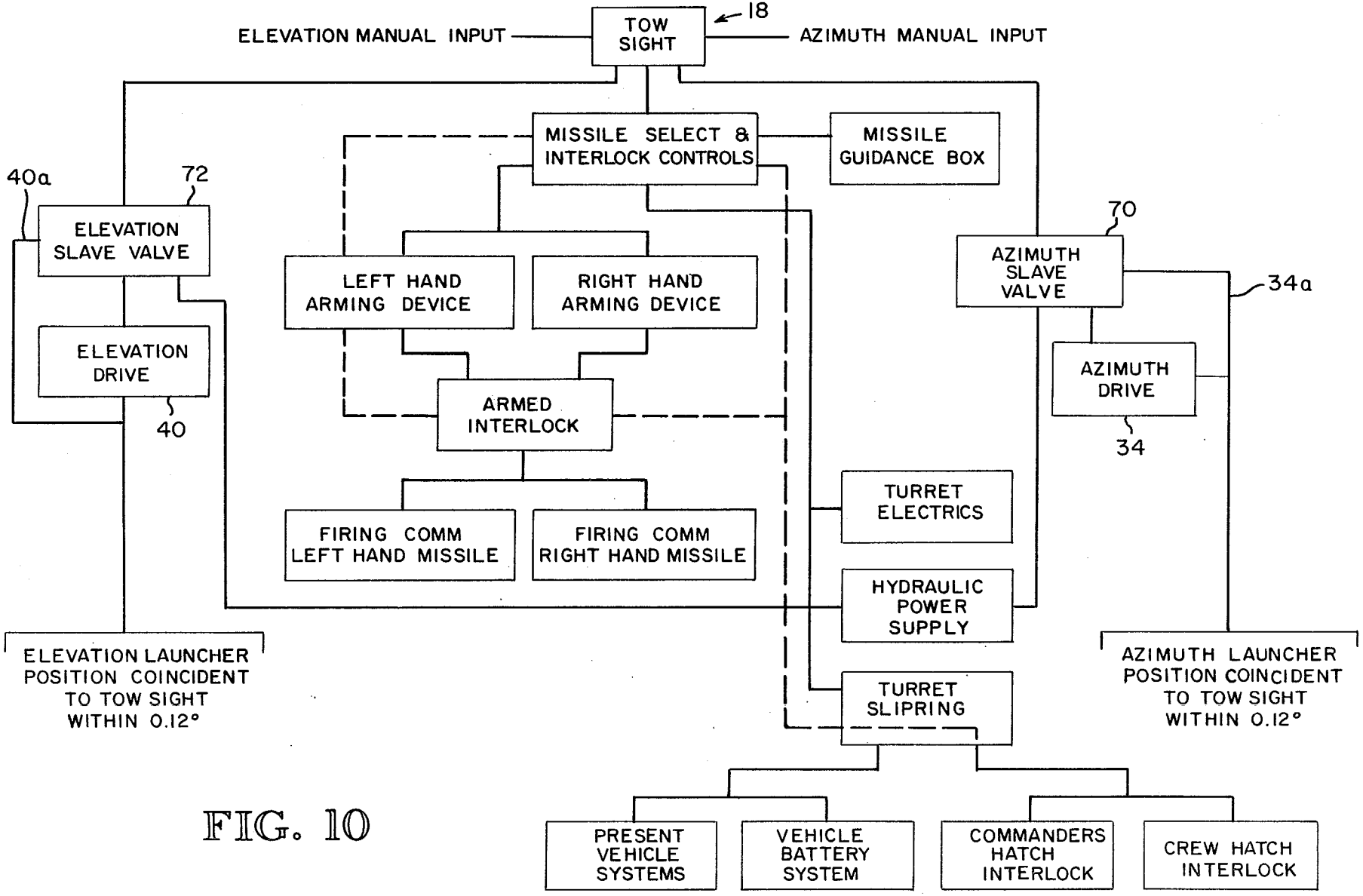
FIG. 10 is an operational block diagram illustrating the functional control operation with a mechanical servo control.

As best shown in FIGS. 1 and 7, the vehicle 10 is provided with a hull 11 having a turret opening 12. In the preferred embodiment of the invention the hull is also provided with a vertically variable platform 13 for supporting the gunner or operator 14. The platform can be elevated by any suitable means and is designed to provide the operator, at eye level, with one of the two vertically spaced sights to be described. The hull is provided with a conventional turret 16, conventional turret servo controls, and an M 27 turret bearing ring such as for use in a M 114 scout vehicle. As is well understood, this turret is heavily armor plated and is rotatable around 360° of rotation so that sighting and use of the weapon may travel through a complete 360° traverse without moving the vehicle.

The TOW missile system, as mentioned eariler, is provided with a traversing unit 18 which is mounted for pivotal movement about a vertical axis SA, called "traverse" movement, on a base 19. Generally the TOW traverse unit is able to be broken down and is mounted onto the base by a conventional band clamp 20. The traverse unit is provided with a bearing 22 for allowing the traverse pivotal movement which bearing is provided with a viscous dampening so that it requires up to forty pounds force to rotate the traversing unit depending on the velocity. It is this viscous dampening which enables the operator to track a target smoothly and accurately. The traverse unit is provided with a sighting mechanism 24 which, as well known, includes a night sight 25 (FIG. 3), a lower day sight 26 and an infrared sensing sight or tracker 27. The sighting mechanism 24 is removable from the traversing unit as a separate unit and is pivotally mounted about a horizontal axis EA for elevation movement about an axis 28. The axis is coincident with an elevational axis EA (FIG. 5) which is the pivotal axis for a bearing 29 that carries a rotor 30 to which the two missile tubes 32 are rigidly attached. Thus as the sights are elevationally rotated to maintain a fix on the target, the missile tubes through the servo control mechanism will also be rotated and the axes of rotation of the sight and the missile tubes will be identical. Since the sight and tracker are mounted on the traverse unit they therefore will follow exactly operator input to the controls. The launch tubes than are slaved by a conventional low performance (2 mills accuracy) servo system.

Because of coincidence between the sight and rotor elevational axes, it can be seen that in a modified form of the invention (not shown), the sight and tracker can, rather than be mounted on the traversing unit, be mounted rigidly directly to the rotor. With this embodiment, the sight and tracker and the missile launch tubes will always be in exact alignment with each other independent of servo controls whereas in the former embodiment, the alignment between the elevation of the sights and elevation of the missile launch tubes in dependent upon the servo control correlation. In other words, in the modified embodiment, the sight and tracker being mounted on launcher rotor, therefore their relationship is fixed, however, now the sight and tracker are also positioned by the servo system, which must be of high performance (2/10 mill accuracy).

The turret, as is well known, is provided with a traverse drive assembly having a hydraulic motor 34 (FIG. 6) which drives, through a reduction gear 36, a pinion 37. The pinion is in meshing engagement with an internal ring gear 38 fixed to the hull 11. Thus, rotation of the reversible, hydraulic motor 34 drives the turret 16 on the ring gear about a turret axis TA. Elevational movement of the rotor and thus the launch tubes 32 is through a hydraulic cylinder 40 (FIG. 5) in a well known manner.

The preferred embodiment of the unique counter rotation mechanism for the base of the TOW traverse unit is best illustrated in FIGS. 2, 7 and 8A. The turret is provided with an annular adapter plate 42 which is bolted to the turret by bolts 43. The adapter plate is provided with a bearing 44 with the inner race attached to the base 19 of the traversing unit 18. A set of three equidistantly spaced, plit anti-backlash planet gears 46 are rotationally secured to the base 19 by spindles 47. These planet gears mesh with a ring gear 48 formed on the plate 42. The planet gears also mesh with a split, anti-backlash sun gear 49 which also meshes with the ring gear 38 on the hull. The sun gear is provided with anti-backlash springs 49*a* in a conventional manner to reduce backlash throughout the planetary system. The plate 42 is also provided with a bottom cover 42*a* which supports the input gears through suitable bearings. The plate 42 is provided with a central opening 42*b* through which the power cables and the like are carried.

Referring to FIGS. 8A–8C it can be seen that in an initial starting position (FIG. 8A), the base 19 is pointed in the direction of the dotted arrow 1, the sights are pointed in the direction of the solid arrow 2. A circle 3 represents a point on the turret and is aligned with the arrows and a square 4 represents a point on the hull also aligned with the arrows.

In FIG. 8B the sight has been moved so that arrow 2 is now turned slightly clockwise. The sight is moved into this position by the manual rotation of the upper traverse unit by the operator. The servo control then moves the turret to maintain its alignment with the arrow 2 and this is indicated by the position of the circle 3. The square 4 on the hull, of course, remains stationary. As the turret has moved to the position indicated by the circle 3, the axis of rotation SA of the base 19 has shifted in a clockwise direction but the base 19 has been counter rotated in the opposite direction so that the arrow 1 remains pointing in the same direction as it had in FIG. 8A. Thus, although it has shifted somewhat from its original starting position, the base has not rotated relative to a fixed point on the hull, but rather has retained its same directional orientation.

An extreme position is shown in FIG. 8C where the arrow 2 on the sights has been shown as being manually rotated 180°. The servo control, of course, also brings the turret to 180° of rotation as shown by the circle 3 but the square on the hull 4 remains stationary as before. Likewise, while the base 19 has now been shifted about axis TA 180° from its original position shown in FIG. 8A, the base still is pointing (arrow 1) in exactly the same direction relative to its initial direction and thus has remained rotationally stationary relative to a pivot point about the turret axis.

Counter rotation of the base 19 can be provided by a number of additional techniques, such as using spur gearing rather than planetary gearing, a universal joint shaft, a flexible non-rotatable shaft connected to the hull floor at the center line of turret rotation, or with a servo system. FIG. 9 illustrates one of these embodiments, that of using a universal joint shaft. In this embodiment all of the components remain the same with the exception that the operator is provided with a seat 60 which is mounted on a bearing 62 concentric with the axis of rotation TA of the turret. A first universal connection 64 is coupled in a fixed relationship with the hull and is swivelly connected to a universal link 66. The universal link 66 is then coupled by universal coupling 68 to the base 19 of the traverse unit which again is mounted on an adapter plate 42 that is secured to the turret 16. In this embodiment also as the turret is rotated the initial direction of the base remains stationary as illustrated in FIGS. 8A–8C.

As an additional embodiment, a servo system arrangement would simply replace the mechanical gear drives between the base 19 and the hull and be controlled by relative rotation between the hull and the turret or, if the turret is stabilized for firing on the move, the servo system can be controlled by the stabilization system gyros which will maintain the control base 19 stationary in azimuth in inertial space.

The servo controls described above are all well known in the art. One operational servo control system for the mounting system of this invention is shown in FIG. 10. The traverse and elevational movements of the sights are sensed and position azimuth or elevation slave valves 70 and 72 which in turn power the hydraulic motor 34 to rotate the turret with the feedback loop 34*a* establishing the position of the turret or the slave valve 72 controls operation of the cylinder 40 which in turn signals its position by a feedback loop 40*a*.

While the functional diagram illustrates an hydraulic servo system, it can also be accomplished by conventional electrical servo controls.

While the preferred embodiments of this invention have been illustrated and described it should be understood that variations will be apparent to one skilled in the art without departing from the principles herein. Accordingly, the invention is not to be limited to the specific embodiment illustrated in the drawing. In particular it should be understood that the sighting and tracking concepts also are applicable to other vehicular mounted weapon systems controlled from within a rotatable armored turret.

The embodiments of the invention in which a particular property or privilege is claimed are defined as follows:

1. A vehicular turret mounting system for a TOW missile system of the type having a traversing unit, said traversing unit having a means providing an elevation pivot axis, an optical sighting and tracking unit mounted for movement about said axis, handle means for manually traversely rotating said traversing unit, means for elevationally pivoting said sighting and tracking unit, and a base having viscous bearing means supporting said traversing unit and for providing a resistance to said manual traverse rotation of the traversing unit, the improvement comprising:

a vehicle having a hull, an opening in the hull, and a turret supported for rotational movement about a turret axis concentric with said hull opening, at least one missile launch tube elevationally pivotally mounted on said turret, a personnel station in said opening generally aligned with said turret axis, means mounting said traversing unit on said turret adjacent the periphery of said hull opening offset from said turret axis, said mounting means including means for holding the orientation of said base stationary with said hull for simulating a ground-supported TOW missile system, and servo means for traversing said turret in response to movements of said traversing unit on said base.

2. The system of claim 1, said orientation holding means including a gear system coupled to said turret and having a plurality of meshed gears of ratios providing a counter rotation to said base equal to the turning distance caused by movements of the turret.

3. The system of claim 2, said gear system including a planetary gear train.

4. The system of claim 1, said orientation holding means including a flexible, non-rotatable link coupled at one end to said hull and at another end to said base.

5. The system of claim 1, wherein said sighting and tracking unit are pivotally mounted on said traversing unit.

6. A vehicular weapon control system comprising at least one weapon mounted on a rotatable turret, said turret being rotatably supported for movement about a turret axis, sighting and tracking means, means supporting the sighting and tracking means on said turret for movement therewith and for rotational movement about a traverse axis offset from said turret axis, said supporting means including a base, servo means for rotating said turret in response to traverse rotation of said sighting and tracking means, and means for holding the base rotationally stationary relative to rotation of said turret axis.

7. The system of claim 6, said base including viscous dampening means to dampen movements of said sighting and tracking means on said base.

8. The system of claim 7, said means for holding the base including gear means for providing a rotation to the base counter to rotation of the turret and proportional thereto so that the base maintains a fixed orientation.

9. The system of claim 8, said gear means including a planetary gear train.

10. The system of claim 7, said means for holding the base including a flexible, non-rotatable link fixed to the vehicle hull.

11. The system of claim 7, said weapon including a missile launch tube mounted for elevational pivoting on said turret, said launch tube movable about a first elevational axis, said sighting and tracking means mounted on said supporting means for elevational pivotal movement about a second elevational axis concentric with said first elevational axis.

* * * * *